US005618040A

United States Patent [19]

Parten

[11] Patent Number: 5,618,040

[45] Date of Patent: Apr. 8, 1997

[54] TENNIS AID

[76] Inventor: Clay G. Parten, 4723 Oakshire, #4, Houston, Tex. 77027

[21] Appl. No.: 596,633

[22] Filed: Feb. 5, 1996

[51] Int. Cl.[6] ..... A63B 69/38

[52] U.S. Cl. ..... 473/461; 473/464

[58] Field of Search ..... 273/29 A, 72; 473/212, 213

[56] References Cited

U.S. PATENT DOCUMENTS

| | | | |
|---|---|---|---|
| 739,450 | 9/1903 | Schnek | 273/29 A |
| 3,606,343 | 9/1971 | Lemon | 473/212 |
| 3,858,881 | 1/1975 | Hurwitz | 273/29 A |
| 4,030,732 | 6/1977 | Vincent | 273/29 A |
| 4,150,821 | 4/1979 | Racz | 273/29 A |
| 5,005,833 | 4/1991 | Groveman et al. | 273/29 A |

*Primary Examiner*—Theatrice Brown
*Attorney, Agent, or Firm*—Bill B. Berryhill

[57] ABSTRACT

A tennis aid for improving the stroke of a tennis player. The aid includes a wrist band for encircling the wrist of a tennis player and an associated elastic cord attached thereto. The cord is attached to the wrist band near its midpoint and at opposite ends thereof may be attached to the head of a tennis racket. When the handle of the racket is properly held by the tennis player tension in the cord will tend to prevent the player from bending or flexing the wrist during a tennis stroke.

10 Claims, 2 Drawing Sheets

TENNIS AID

BACKGROUND OF THE INVENTION

1. Field of the Invention

The present invention pertains to training aids. More specifically, the present invention pertains to a training aid for improving the stroke of a tennis player.

2. Description of the Prior Art

It is important, in most tennis strokes, for the wrist to remain unflexed or bent during a complete stroke of the tennis racket. This is one of the most difficult concepts to teach a beginning tennis player.

Many aids have been devised to teach the use of sports equipment or to minimize adverse reactions to the use of such equipment. For example, Hurwitz U.S. Pat. No. 3,858,881 discloses a tennis aid which is designed to prevent development of or to help cure a condition known as "tennis elbow". Tennis elbow apparently results from shock transmitted to the arm by repeated impact of a tennis ball on the tennis racket. The tennis aid of Hurwitz provides an attachment which reduces this shock. A secondary purpose of the apparatus is to provide a tennis aid to help in teaching the novice player how to properly hold and use the racket for best playing results.

In Bickham U.S. Pat. No. 4,720,106 another tennis device is disclosed for reducing vibrations caused by impact of the ball with the strings of a tennis racket. It is indicated that such vibration is believed to cause gout and other arthritic diseases, as well as softening of cartilage in the forearm. Thus, this device is designed to reduce vibration and also for improving strokes of the user.

Both of the patents just mentioned provide tennis aids which are primarily for reducing effects of vibration and resulting adverse effects to the forearm and elbow. Secondarily, they are supposed to improve the stroke of the beginning tennis player. However, neither one of these devices appear to be designed to prevent bending or flexing of the wrist during a stroke of the racket. Furthermore, these devices appear to be unwieldy and impractical. In the Hurwitz patent, a band is placed around the forearm. An elastic band connects the band and the handle of the racket at a midpoint thereof. It appears that it would be difficult to maintain these items in proper position, the arm band and the connection with the handle being subject to sliding from proper position. In the Bickham patent a relatively rigid support member projects from one side of the racket and would appear to interfere with certain movements.

SUMMARY OF THE PRESENT INVENTION

The present invention provides a tennis aid which is designed to assist in teaching the beginning or novice tennis player not to bend or break the wrist during strokes of the racket. The tennis aid of the present invention includes a wrist band for encircling the wrist of the arm of the tennis player by which he or she holds a tennis racket. An elastic cord is attached, near its midpoint, to the wrist band. One end of the cord is attachable to one side of the head of a tennis racket. The opposite end of the cord is attached to the opposite side of the tennis racket head. The length of the elastic cord is such that when the handle of the tennis racket is properly gripped by a tennis player, an equal and slight amount of tension will he placed on the cord at either end thereof. If the player bends or breaks his wrist during a stroke, additional tension is placed on the cord so that the player, by feel, realizes that he has improperly bent the wrist. Furthermore, the tennis aid then tends to correct this condition by creating a force which tends to move the hand and wrist to the proper position.

The tennis aid of the present invention involves two components: the wrist band and the elastic cord. The elastic cord is provided with adjustable attachment devices at one or both ends thereof to permit the cord to be adjusted for greater or lesser tension and/or to accommodate players and rackets of different sizes.

Thus, the tennis aid of the present invention is relatively inexpensive and easy to use. Most importantly, it is extremely effective in teaching the student not to bend or break the wrist during a stroke. Many other objects and advantages of the invention will be apparent from reading the description which follows in conjunction with the accompanying drawings.

DESCRIPTION OF A PREFERRED EMBODIMENT

Figure 1:
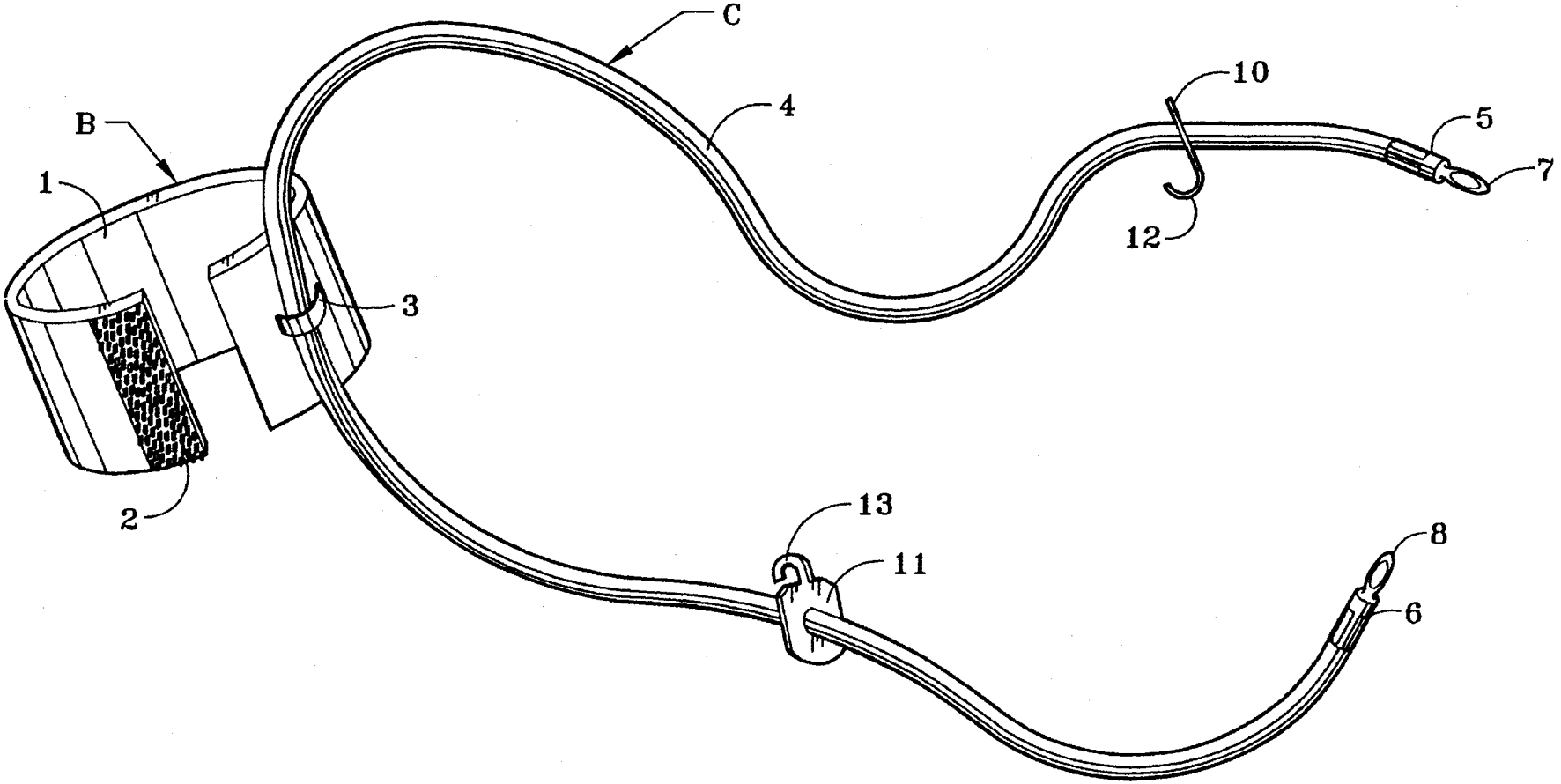
FIG. 1 is a pictorial illustration of the tennis aid of the present invention, according to a preferred embodiment thereof.

Referring first to FIG. 1, there is shown a tennis aid of two major components: a wrist band B and a cord assembly C. The wrist band B comprises an elongated band 1 of any suitable flexible material such as a fabric, leather, plastic or the like which may be placed around a tennis player's wrist. The ends of the band are provided with some means of attachment so that the band 1 may encircle the wrist and be tightly affixed thereto. In FIG. 1, the means of attachment is illustrated as a fabric separable material commercially known as "Velcro". However, snaps, hooks or other types of attachments could be used. The wrist band B is also provided with a small loop 3 through which the cord assembly C may pass in a slidable connection.

The cord assembly C comprises an elastic cord 4 of any suitable material. Cord sometimes known commercially as "Bungey Cord" has been found to be quite suitable. As previously indicated, the cord 4 of the cord assembly C is threaded through and slidingly engages the loop 3 of the wrist band B.

In a preferred embodiment, both ends of the elastic cord 4 are provided with attachment components 5, 6 made of metal, plastic or the like. These attachment components 5 and 6 are firmly attached in any suitable manner to the ends of the cord 4 and may be provided with eyes 7 and 8 for engagement by hooks 12, 13, respectively, of mating attachment components 10, 11 respectively. The components 10 and 11 may also be made of metal, plastic or the like and are provided with holes through which the elastic cord 4 passes for sliding engagement with these components 10, 11.

Figure 2:
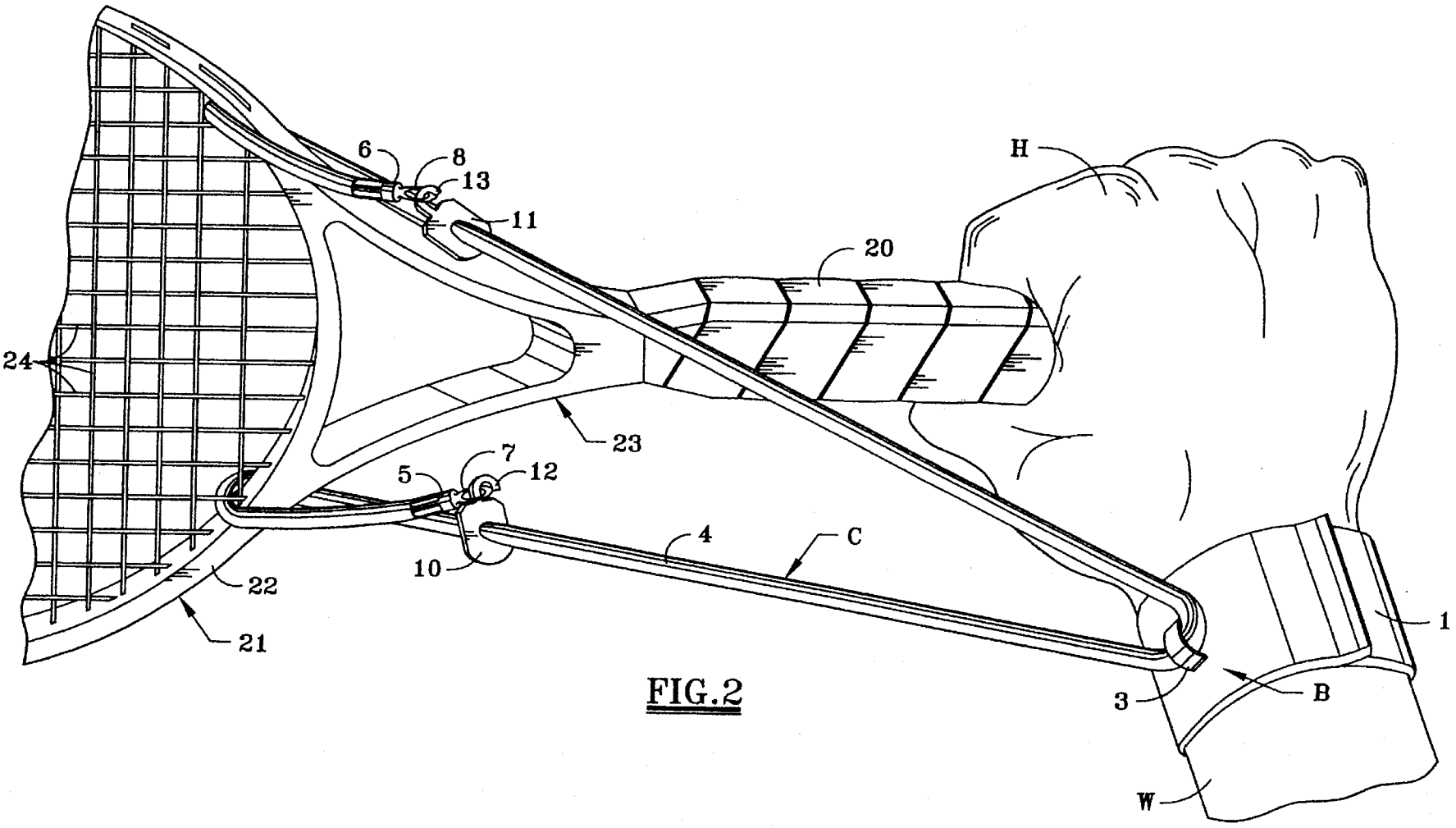
FIG. 2 is a pictorial illustration of the tennis aid of the present invention, according to a preferred embodiment thereof, as it would be attached to the wrist of a tennis player and the tennis racket being held thereby.

Referring now also to FIG. 2, the training aid of the present invention is shown attached to the wrist W of a tennis player whose hand H is gripping the handle 20 of a tennis racket 21. The tennis racket 21 has a head or frame 22 attached to the handle 20 by a throat portion 23. The particular racket illustrated in FIG. 2 is one with an open throat. However, many rackets have a closed throat. The racket head 22 is of course strung with racket strings 24.

Each end of the cord assembly C is attached to one side of the head 22 of the tennis racket 21 near the throat 23 thereof. This is accomplished by inserting the attachment components 5 and 6 through a space between strings 24 and bending or looping the ends of the cord 4 back toward the tennis player's hand where the eyes 7 and 8 thereof may be engaged by the hooks 12 and 13 of attachment components 10 and 11. The attachment components 10 and 11 may be moved along the cord 4 so that the length of the cord assembly C may be adjusted for greater or lesser tension therein and/or to accommodate players and rackets of different sizes.

When the handle 20 of the racket 21 is properly held by the hand H of the tennis player and the cord assembly C is properly adjusted, tension in the cord 4 on either side of the looped connection 3 should be slight and substantially equal. As indicated, the attachment components 10 and 11 can be adjusted for the proper tension. The tennis player's wrist W will sense the substantially equal tension. However, if the tennis player's wrist W is bent or broken during a stroke, the cord assembly C will be placed in substantially greater tension. This will be immediately sensed by the tennis player to indicate that he has improperly bent or broken his wrist. Furthermore, the cord assembly C will attempt to correct this condition by producing a force at the wrist to overcome bending or breaking of the wrist. After use of the training aid for a sufficient period of time, the student will have learned the proper stroke at which time the tennis aid may be removed.

As can be seen, the tennis aid of the present invention is relatively simple in construction and use. It would be inexpensive and readily available to a student of tennis. Most importantly, it is very effective in teaching the student not to bend or break the wrist during the stroke.

A single embodiment of the invention has been described herein. However, many variations of the invention may be made without departing from the spirit of the invention. Accordingly, it is intended that the scope of the invention be limited only by the claims which follow.

I claim:

1. A tennis aid, in combination with a tennis racket having a head attached to a handle by a throat, for improving the stroke of a tennis player, said aid comprising:

wrist means attachable to the wrist of the arm of a tennis player by which said tennis racket is held; and an elastic cord attached, near the midpoint thereof, to said wrist means, one end of said cord being attached to one side of said head of said tennis racket near said throat thereof, the opposite end of said elastic cord being attached to the opposite side of said racket head near said throat thereof, said elastic cord being of a length which, when the handle of said tennis racket is properly gripped by said tennis player, will place said cord in predetermined tension.

2. The tennis aid of claim 1 in which said cord is attached to said wrist means in a slidable connection so that said cord may be adjusted to provide substantially equal tension in said cord from both ends thereof.

3. The tennis aid of claim 1 in which at least one end of said cord is provided with a first attachment member engageable with a second attachment member slidably carried by said cord permitting said cord to be adjusted for greater or lesser tension therein and to accommodate players and rackets of different sizes.

4. The tennis aid of claim 3 in which both ends of said cord are provided with first attachment members engageable with corresponding second attachment members slidably carried by said cord permitting said cord to be adjusted at either end thereof.

5. The tennis aid of claim 3 in which said first member fixed to said one end of said cord and said second member slidably positionable on said cord, when engaged, cooperate to provide a loop at said one end of said cord by which said one end of said cord is attached to said one side of said tennis racket head.

6. The tennis aid of claim 1 in which said wrist means comprises an elongated band of flexible material, the ends of which may be brought together and attached so that said band encircles said tennis player's wrist.

7. The tennis aid of claim 6 in which said band is provided with a loop through which said elastic cord may be passed for said attachment with said wrist means.

8. A tennis aid, in combination with a tennis racket having a head and handle, for improving the stroke of a tennis player comprising:

a wrist band for encircling the wrist of the arm of a tennis player by which he holds said tennis racket; and an elastic cord attached to said wrist band near the midpoint thereof, each end of said cord being provided with attachment means by which opposite ends of said cord are attached to said head of said tennis racket, one end on each side thereof, so that when the handle of said tennis racket is properly held by said tennis player said cord will be placed in tension applying predetermined and predirected forces to said player's wrist.

9. A tennis aid as set forth in claim 8 in which at least one of said attachment means comprises first and second members, said first member being fixed to one end of said cord, said second member being slidably carried on said cord, said first member being engageable with said second member to form a loop for attachment to said tennis racket head, allowing said cord to be lengthened or shortened for lesser or grater tension therein or to accommodate players and rackets of different sizes.

10. A tennis aid as set forth in claim 9 in which said cord is attached to said wrist band in a slidable connection so that said cord may be adjusted to provide substantially equal tension in said cord from both ends thereof.

* * * * *